United States Patent [19]

Eaton

[11] 4,063,441

[45] Dec. 20, 1977

[54] APPARATUS FOR BENDING TUBES

[75] Inventor: Homer L. Eaton, Balboa, Calif.

[73] Assignee: Eaton-Leonard Corporation, Santa Ana, Calif.

[21] Appl. No.: 692,585

[22] Filed: June 3, 1976

Related U.S. Application Data

[63] Continuation-in-part of Ser. No. 614,946, Sept. 19, 1975, abandoned.

[51] Int. Cl.[2] ..... B21D 7/04

[52] U.S. Cl. ..... 72/151; 72/154; 72/155

[58] Field of Search ..... 72/7–9, 72/21, 149, 150, 151, 154–159, 310, 311, 318, 369

[56] References Cited

U.S. PATENT DOCUMENTS

| | | | |
|---|---|---|---|
| 2,382,745 | 8/1945 | Powers | 72/7 |
| 2,810,422 | 10/1957 | Bower | 72/154 |
| 2,924,261 | 2/1960 | Fredericks | 72/21 |
| 2,974,706 | 3/1961 | DeWitt | 72/154 X |
| 2,988,127 | 6/1961 | Gray | 72/21 |
| 3,145,756 | 8/1964 | Hill | 72/7 |
| 3,155,139 | 11/1964 | Hautau | 72/150 |
| 3,156,287 | 11/1964 | Munro | 72/8 |
| 3,242,710 | 3/1966 | Hamlin | 72/156 |
| 3,303,683 | 2/1967 | Schmidt | 72/154 |
| 3,352,136 | 11/1967 | Clarke | 72/9 |

*Primary Examiner*—E. M. Combs
*Attorney, Agent, or Firm*—Gausewitz, Carr & Rothenberg

[57] ABSTRACT

A tube bend is started by compression bending and continued by draw bending. Conventional bending equipment is employed with one die slightly modified so that normal machine operation causes the pressure die to initially operate in a compression bending mode and then to operate in a draw bending mode. The tube is clamped between a rotatable bend and clamp die. The pressure die presses the tube against the bend die and initially moves with the tube so as to exert little axial restraint. The pressure die is caused to exert increasing pressure upon the tube, and its motion with the tube is stopped after a short initial travel, whereupon the pressure die restrains the tube as the bend and clamp dies continue to rotate, thereby to effect a draw bending to the completion of the bend.

31 Claims, 17 Drawing Figures

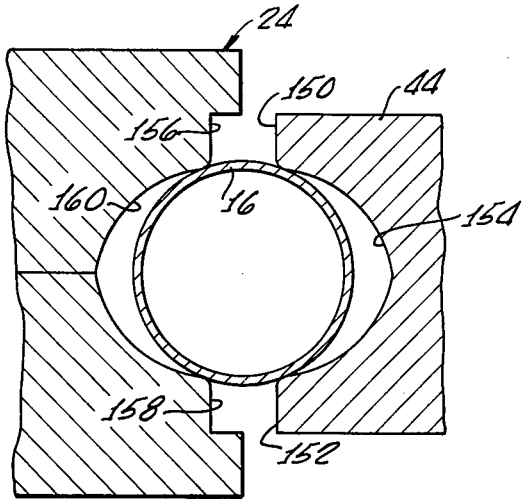
FIG. 7.
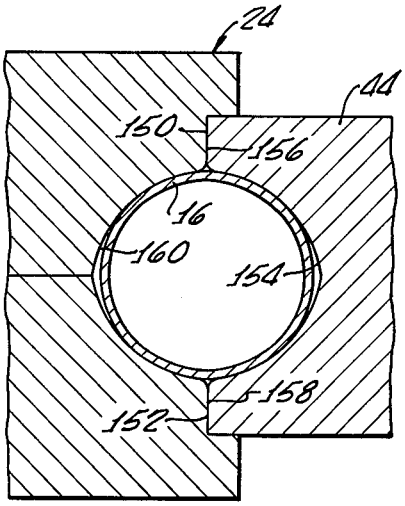
FIG. 8.
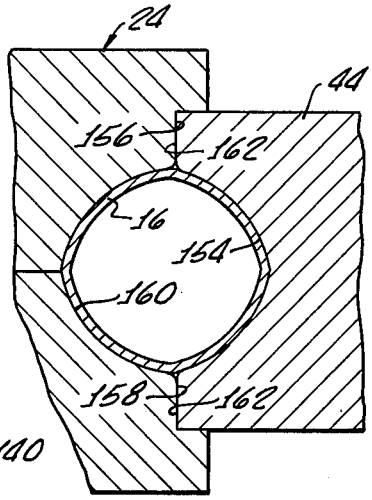
FIG. 9.
FIG. 3.
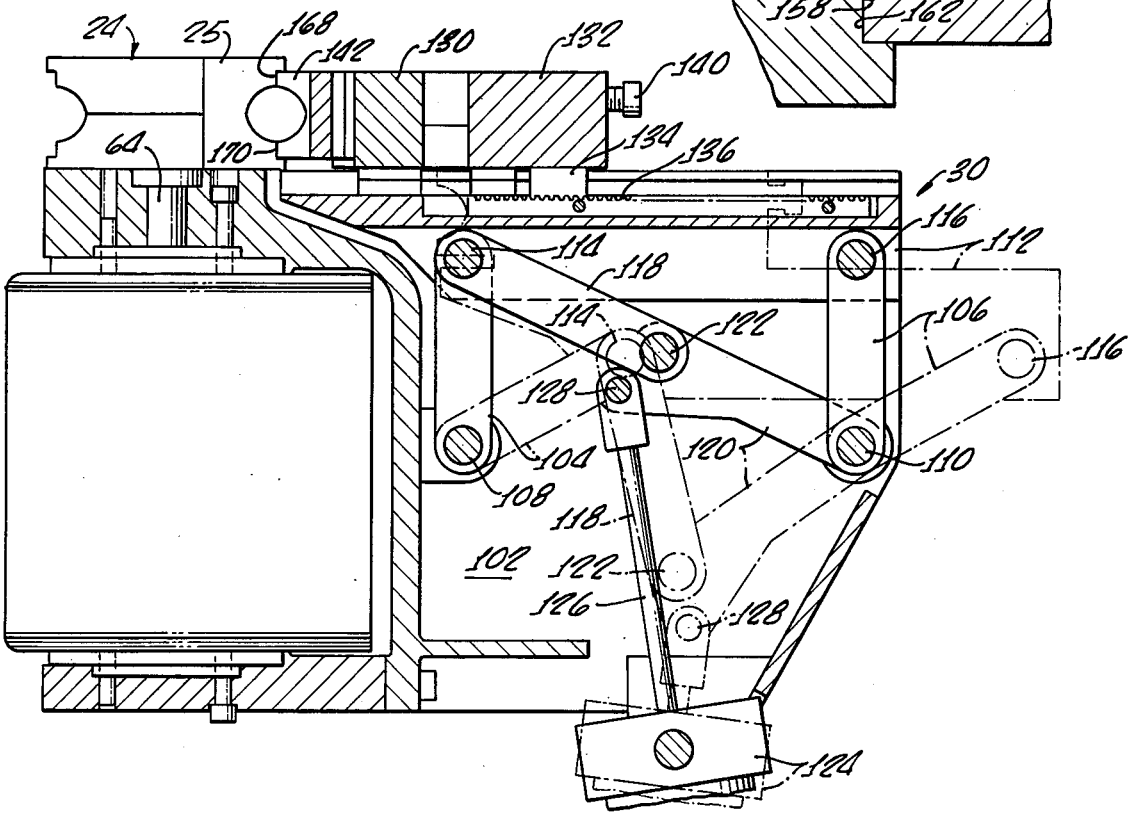

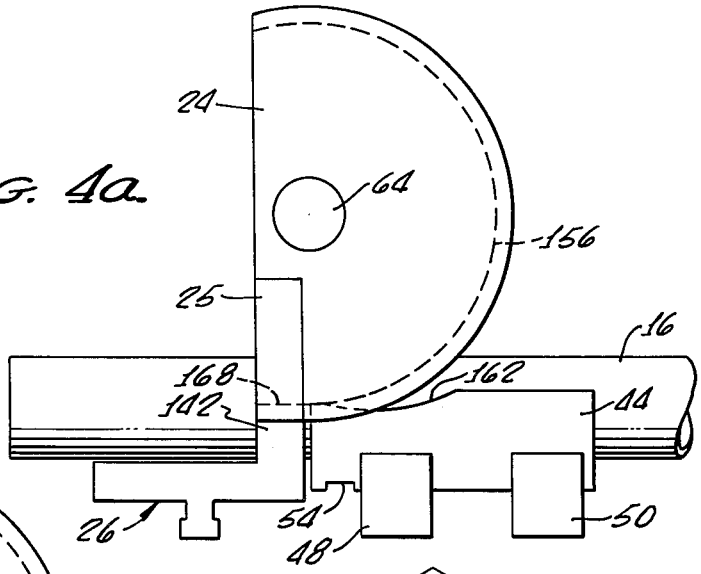
FIG. 4a.
FIG. 5a.
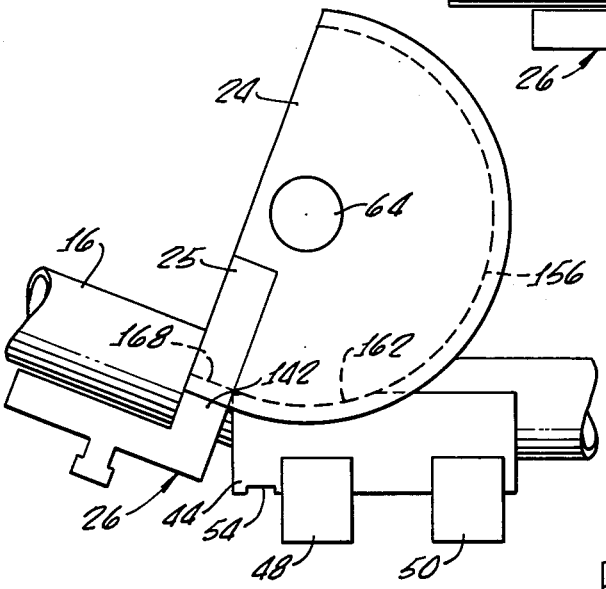
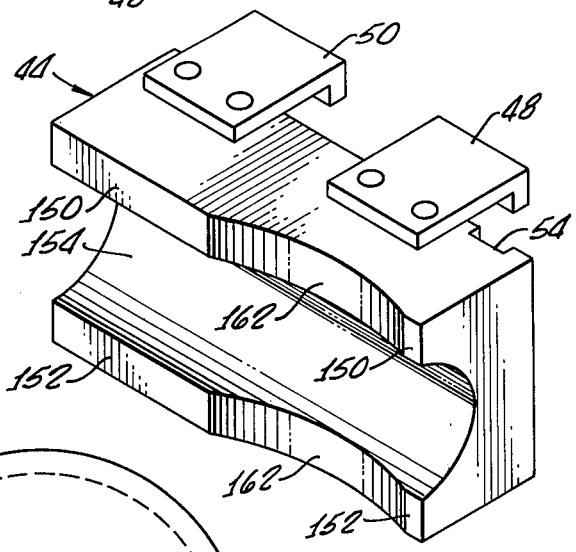
FIG. 10.
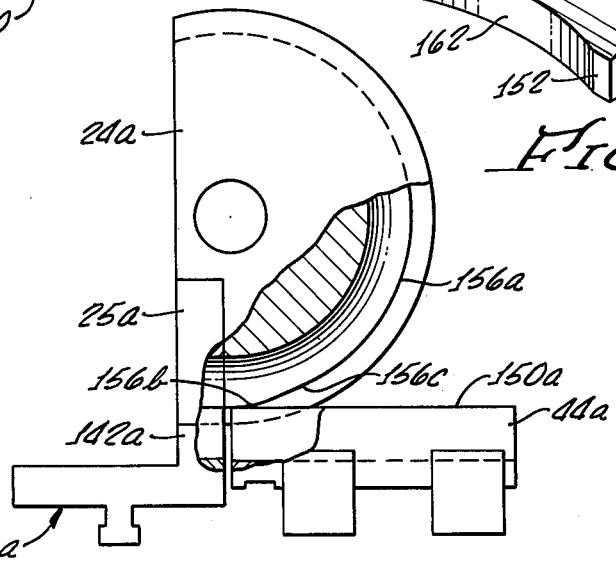
FIG. 11.

FIG. 5.
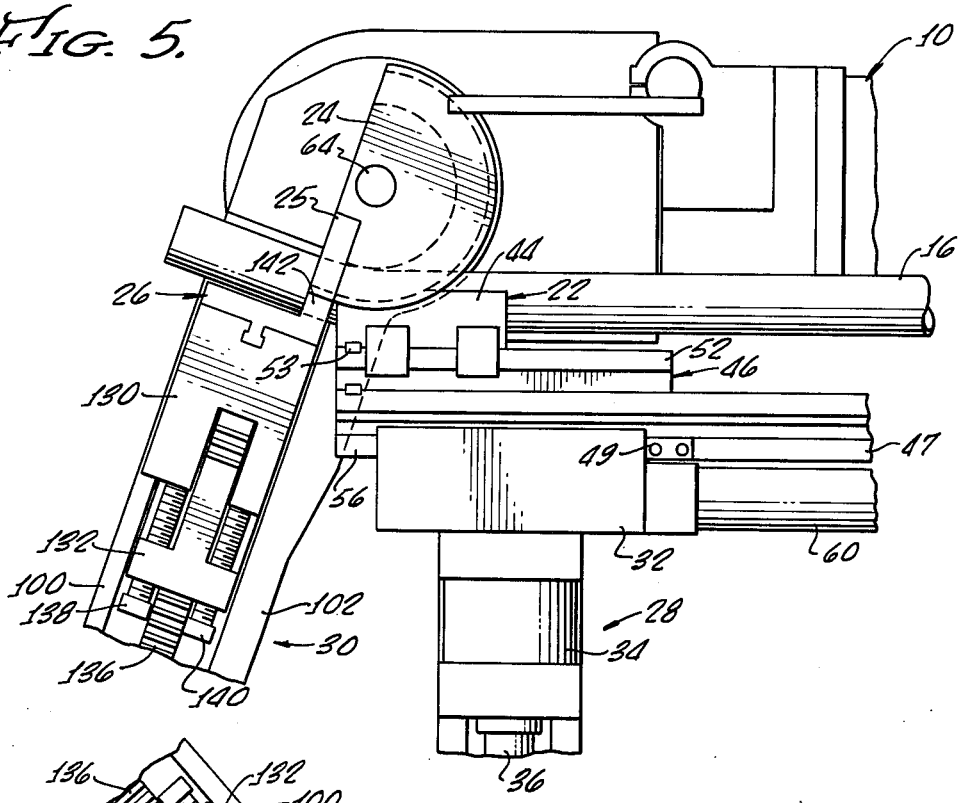
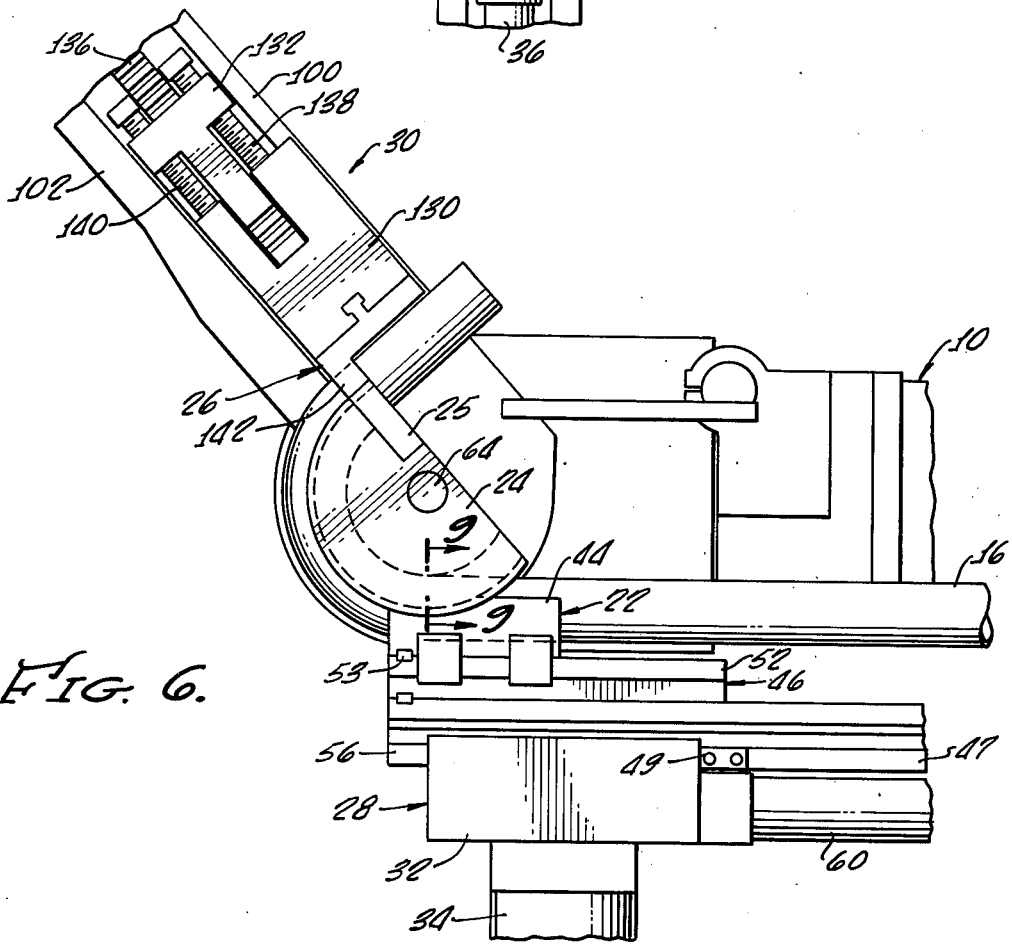
FIG. 6.

FIG. 12.
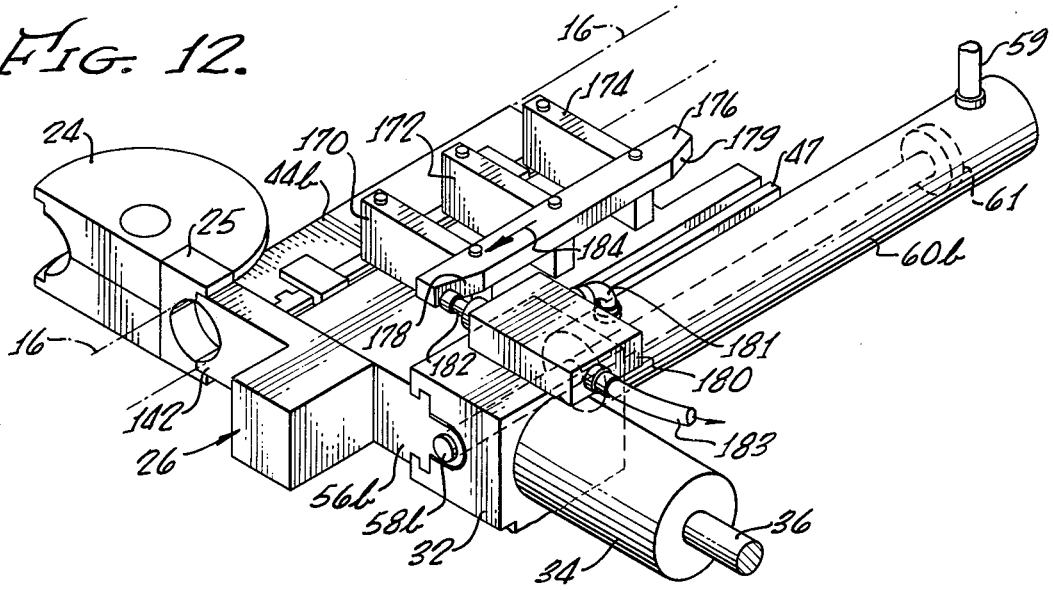
FIG. 14.
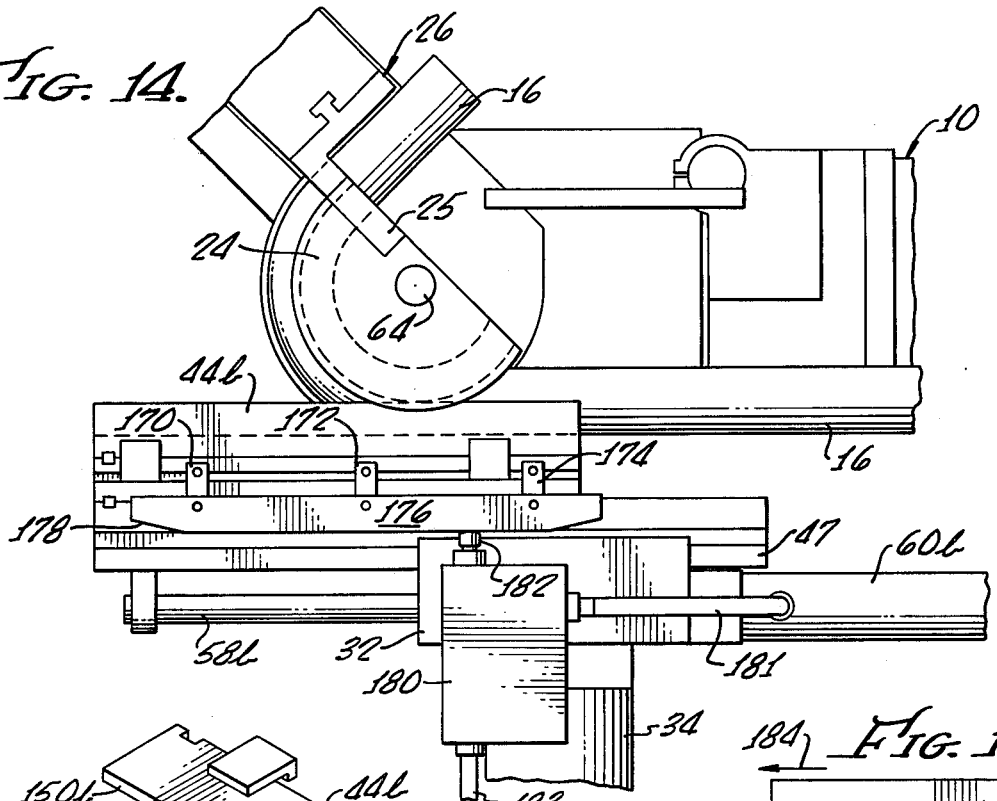
FIG. 13.
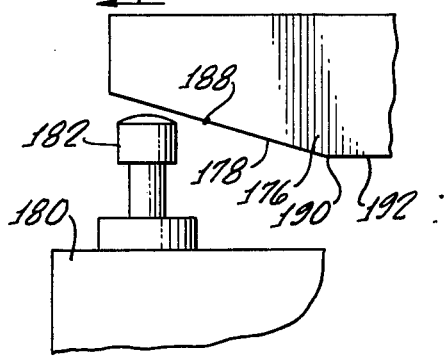
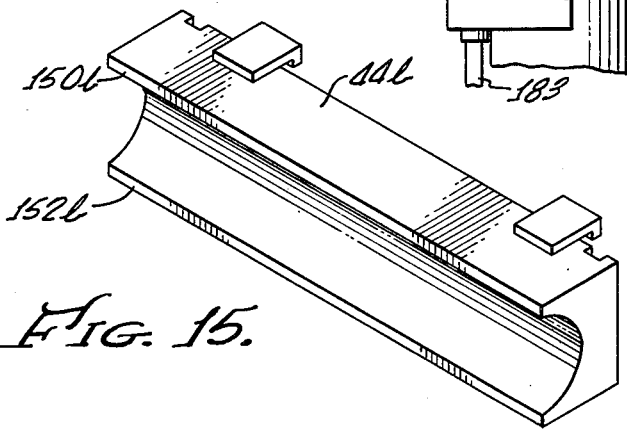
FIG. 15.

APPARATUS FOR BENDING TUBES

This application is a continuation in part application of my prior application for Method and Apparatus for Bending Tube, Ser. No. 614,946, filed Sept. 19, 1975, abandoned.

BACKGROUND OF THE INVENTION

The present invention relates to methods and apparatus for bending tubes and more particularly concerns improved apparatus and methods of draw bending.

A common form of bending tubes, particularly automobile exhaust pipes, is the press bending method exemplified by U.S. Pat. Nos. 3,808,856 to Lance, and Inda 3,426,562 wherein a ram die presses the tube against a pair of movable but restrained wing dies. Press bending is useful fo bending large numbers of identical tubes but is less satisfactory when it is desired to bend only a relatively small number of tubes of any given configuration. This is so because of the large amount of time and skill embodied in adjusting the machine for individual bead configurations and the relatively great amount of setup time required.

Compression and draw bending may involve less setup time but each has certain disadvantages. In one type of compression bending a tube is clamped to a rotary bend die by a clamp die and another section of the tube is pressed against the bend die by a pressure die. The bend and clamp dies are rotated together with the tube clamped therebetween to wrap the tube around the bend die, concomitantly moving the tube axially. For bends over 15° to 20° of arc, compression bending causes wrinkling or buckling of the tube material on the inside of the bend, a phenomenon which requires difficult, costly and unsatisfactory arrangements to avoid. Thus, a die collar may be employed to gather material on the inside of the bend. This is costly and may interfere with fluid flow through the completed tube.

In some forms of rotary draw bending, the bending apparatus may be similar to that employed in the compression bending so that the tube is clamped between the clamp die and the rotary bend die and the two are rotated together to bend the tube around the bend die. However, as distinguished from the compression bending in which no axial tension is applied to the tube, the draw bending arrangement provides some means to exert axial tension on the tube as it is bent around the bend die thereby effecting a substantial axial elongation of the tube as it is bent. This axial elongation, particularly on the inner side of the bend, overcomes the wrinkling or buckling problem of the compression bending, but at the cost of other disadvantages. For the axial elongation, a sufficient restraint must be placed upon the tube by a pressure die so that the material of the tube can be stressed past its yield point. This is achieved by exerting sufficient pressure on the tube by a pressure die, and concomitantly by the clamp die which presses a forward portion of the tube against the bend die. In order to achieve adequate pressure on the tube between the clamp and bend die for draw bending, the clamp die must press against the tube over a significant length of the tube. Commonly, the clamp die has a length parallel to the extent of the tube in the order of three times the tube diameter. If the clamp die is much smaller than this, the tube is likely to slip relative to the clamp die or, in the alternative, such great force must be exerted by the clamp upon the tube that the tube is often unacceptably deformed. Because large clamp dies are required for draw bending, it it not possible in this type of bending to form tube bends close together. Two successive bends cannot be any closer to each other than the length of the clamp die.

Some types of draw bending employ a mandril within the tube, which itself introduces still other problems. The mandril may operate to exert a force that restrains axial motion of the tube as the clamp and bend die rotate with the clamp tube about the bend die axis. In many cases, this restraint is so great that the pressure die pressing the tube against the bend die with the mandril in the tube is actually driven forward in the direction of the tube axis as the tube is pulled around the bend die. This is done in order to decrease the axial restraint exerted by the friction of the mandril within the tube although sufficient friction remains for drawing of the tube. This forward motion of the pressure die continues in such an operation throughout the entire bending motion.

U.S. Pat. Nos. 3,145,287 to H. Monroe and to W. P. Hill 3,145,756, are exemplary of apparatus for performing this type of rotary draw bending wherein a pressure die, also termed a wiper die, is driven forwardly with the tube to preclude excessive stretching or elongation of the tube due to the friction of the mandril and pressure of the wiper die.

Thus, in draw bending employing a mandril, the tube is stretched as it is bent around the bend die, being firmly grasped by a relatively long clamp die and pressed against the bend die at a foward portion, and being frictionally retained by a combination of pressure die, bend die and internal friction of the mandril at a rearward portion.

The use of the mandril has drawbacks. The mandril is costly. Its operation is often difficult in the presence of internal weld scars on the tubing. Internal lubrication of the tube is required and the operation is slow and expensive.

Accordingly, it is an object of the present invention to perform tube bending with a minimum of the abovementioned disadvantages.

SUMMARY OF THE INVENTION

In carrying out principles of the present invention in accordance with the preferred embodiment thereof draw bending of a tube is achieved without use of a long clamp die and without the use of a mandril. A bend is initiated by compression bending and continued by draw bending. More specifically, a tube bend is started without significantly restraining axial motion of the tube relative to the die and then the bend is continued while applying a significant axial restraint on the tube. The initial bending of the tube provides sufficient friction to hold the tube on the bend die, without a long clamp die, but with a frictional grip strong enough to permit the subsequent drawing action. Still more specifically a first portion of a tube to be bent is pressed against a first die which is rotated together with the first tube portion. A second portion of the tube is pressed with at least a second die which initially is moved in the direction of rotation of the first die. Thereafter, motion of the second die is restrained while rotation of the first die together with the clamped tube portion continues. According to a feature of this method, pressure exerted by the the second die upon the tube is increased after initiation of rotation of the first die. Alternatively, the second die continues to move with the tube and after an initial rotation restraining force is applied that tensions the tube but does not stop the second die.

Appartus for carrying out principles of the present invention may include a rotatable bend die, a clamp die rotatable therewith for pressing a tube between the bend and clamp dies, and a pressure die mounted for motion with the tube to be bent and adapted to be pressed against the bend die with a portion of the tube therebetween. According to a feature of the invention, such apparatus is provided with means for increasing the pressure of the bend and pressure dies upon the tube portion therebetween as bending starts and also with means for restraining the motion of the pressure die with the tube to be bent. Alternatively, means are provided to resist, but not prevent, motion of the pressure die with the tube, thereby to tension the tube after an initial bending.

BRIEF DESCRIPTION OF THE DRAWINGS

FIG. 3 is a section taken on lines 3—3 of FIG. 4;

FIGS. 4, 5 and 6 are top plan views showing the apparatus of FIG. 1 in different stages of a single bend;

FIGS. 4*a* and 5*a* are enlarged fragmentary views corresponding to FIGS. 4 and 5, respectively;

FIGS. 7, 8 and 9 are fragmentary cross-sectional views of die cavities and tube in certain steps of the operation of the apparatus;

FIG. 10 is a perspective view of the pressure die;

FIG. 11 shows a modification of the apparatus of FIG. 1;

FIG. 12 is a perspective view of a modified form of the apparatus at the start of a bend according to principles of the present invention;

FIG. 13 is an enlarged detail view illustrating the relative position of pressure die cam and pressure control valve actuator at the start of a bend;

FIG. 14 is a plan view of the bending apparatus of FIG. 12 upon completion of a bend of approximately 135°; and FIG. 15 is a perspective view of the clamp die of FIG. 12.

DETAILED DESCRIPTION

Figure 1:
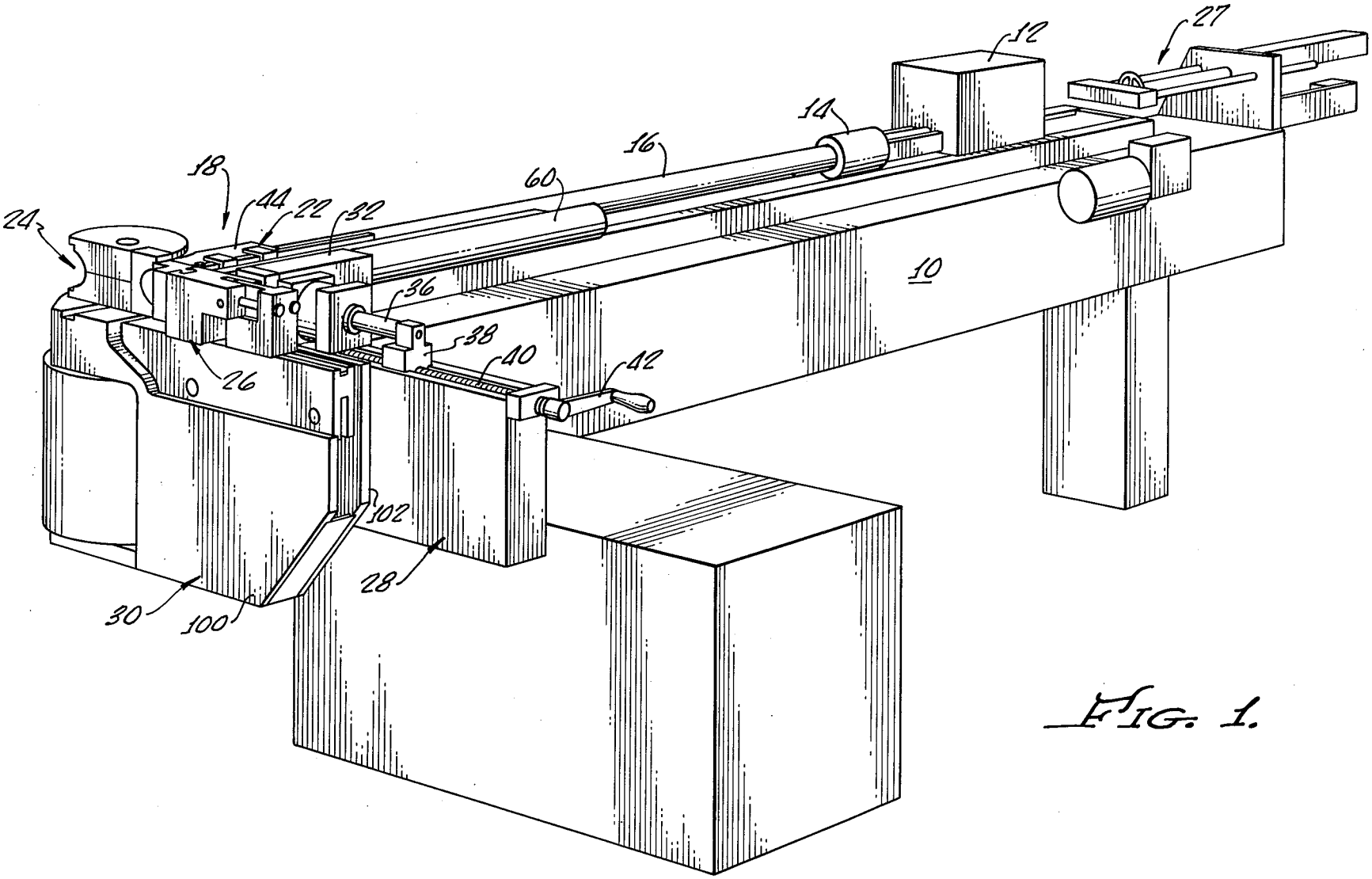
FIG. 1 is a perspective view of bending apparatus embodying principles of the present invention.

The bending machine illustrated in FIG. 1 is merely exemplary of many different types of bending machines that may have the bending head thereof modified to enable them to perform the combined compression and draw bending described herein. Such other bending apparatus include but are not limited to the machines such as those described in the aboveidentified patents to Monroe and Hill, among others. Bending machines having the pressure die mounted on the movable arm can also be modified to enable practice of the method of this invention. As the description proceeds it will be appreciated that many bending machines of a variety of types may be modified to perform the present invention merely by modifying the wiper or pressure die and its motion or making such other modifications as will be apparent from the present description.

The bending machine illustrated in FIG. 1 is described in a copending application for Tube Bending Machine and Carriage Therefor, Ser. No. 567,288, filed Apr. 11, 1975, now U.S. Pat. No. 3,974,676, by Homer L. Eaton, and assigned to the assignee of the present invention. The disclosure of such copending application is fully incorporated herein by this reference. This bending machine is adapted for either automatic or manual control and has general functions and operations which are well known as typically described in U.S. Pat. Nos. 3,821,425, 3,808,856, 3,557,585, 3,426,562, 3,352,136 and 3,156,287, among others. Briefly, the machine comprises a fixedly supported bed 10 having a moving carriage assembly 12 that carries a rotatable chuck 14. The latter grips a tube 16 which is to be advanced and rotated for preselected positioning with respect to dies carried by a machine bending head generally indicated at 18. When used for draw bending, the machine includes a pressure die 22, a rotatable bend die 24, and a clamp die 26, rotatable together with the bend die. Bend die 24 has a replaceable insert 25 for cooperation with the clamp die 26.

For a bending operation, the carriage advances the tube 16 and the chuck rotates the tube for positioning with respect to the dies. In general, in this type of machine, the pressure die 22 clamps a rearward portion of the tube 16 to the bend die. Both the clamp die and bend die clamp a forward portion of the tube and are rotated about a substantially vertical axis in the illustrated arrangement. This bends the tube about the bend die. Thereafter, the dies are retracted, the carriage is advanced, and the chuck is rotated to properly position the tube both longitudinally and rotatably for the next bend.

In use of the machine of FIG. 1 for conventional draw bending, a mandril may be inserted into the tube prior to each bend, properly positioned with respect to the tube portion to be bent and thereafter withdrawn by means of a substantially conventional mandril extracting mechanism 27 mounted at the rear of the bed 10. The mandril is not employed in the present invention. Details of the carriage and chuck mechanism and drive therefore are described in the above-identified copending application of Homer L. Eaton.

Bend head assembly 18 in general includes a stationary arm assembly 28 on which is mounted the drive mechanism for rotating the bend die. Also mounted on the stationary arm is the mechanism for operating the wiper or pressure die 22. A swinging bend arm assembly 30 is mounted for rotation with the bend die 24 about the axis of the latter and carries the clamp die and its operating mechanism.

Stationary arm assembly 28 (FIGS. 1, 2, 4) includes a body having walls 29, 31 that slidably mount a pressure die bolster 32. Bolster 32 fixedly carries a pressure die pressure cylinder 34 having a cylinder shaft 36 that is connected to and bears against a die adjustment plate 38. Plate 38 also is slidably mounted to walls 29, 31 for adjustment by means of a screw 40 and handle 42.

The pressure die assembly 22 includes the die bolster 32 and the pressure die itself, designated at 44, which is fixedly but detachably connected to a pressure die slide 46. Slide 46 is slidably mounted in bolster 32 for motion from right to left, as viewed in FIG. 4, a direction parallel to the axis of the tube 16. Die 44 (FIG. 10) fixedly carries a pair of brackets 48, 50 that are slidably engaged over an upstanding leg 52 of slide 46. A key 53 carried by the slide 46 is slidably received in a vertically extending groove 54 in the die 44 to prevent relative motion of the die with respect to slide 46.

Slide 46 carries a fixed laterally extending tongue 56 which is slidable together with the slide relative to and within the bolster 32. Tongue 56 is fixedly connected to an end of a piston rod 58 carried by a piston (not shown) which is operably mounted within an hydraulic boost cylinder 60 that is fixedly mounted to and carried by die bolster 32. Pressure die slide 46 includes a portion 47 (FIG. 4) extending rearwardly beyond bolster 32. Fixedly mounted on the rearward portion 47 at a position spaced to the rear of bolster 32 when the pressure die and its slide are in a rearmost position is an upwardly projecting lug or stop 49 that moves forward with the die and its slide 46 until it abuts the rear surface of bolster 32, whereupon further forward motion (to the left in FIG. 4) of pressure die 44 and its slide is prevented.

Thus, pressure die 44 is movable in the direction of the axis of tube 16 by means of the booster cylinder 60 which drives the pressure die slide 46 and is also slidable with bolster 32 toward the bend die 24 under pressure exerted by pressure cylinder 34.

Figure 2:
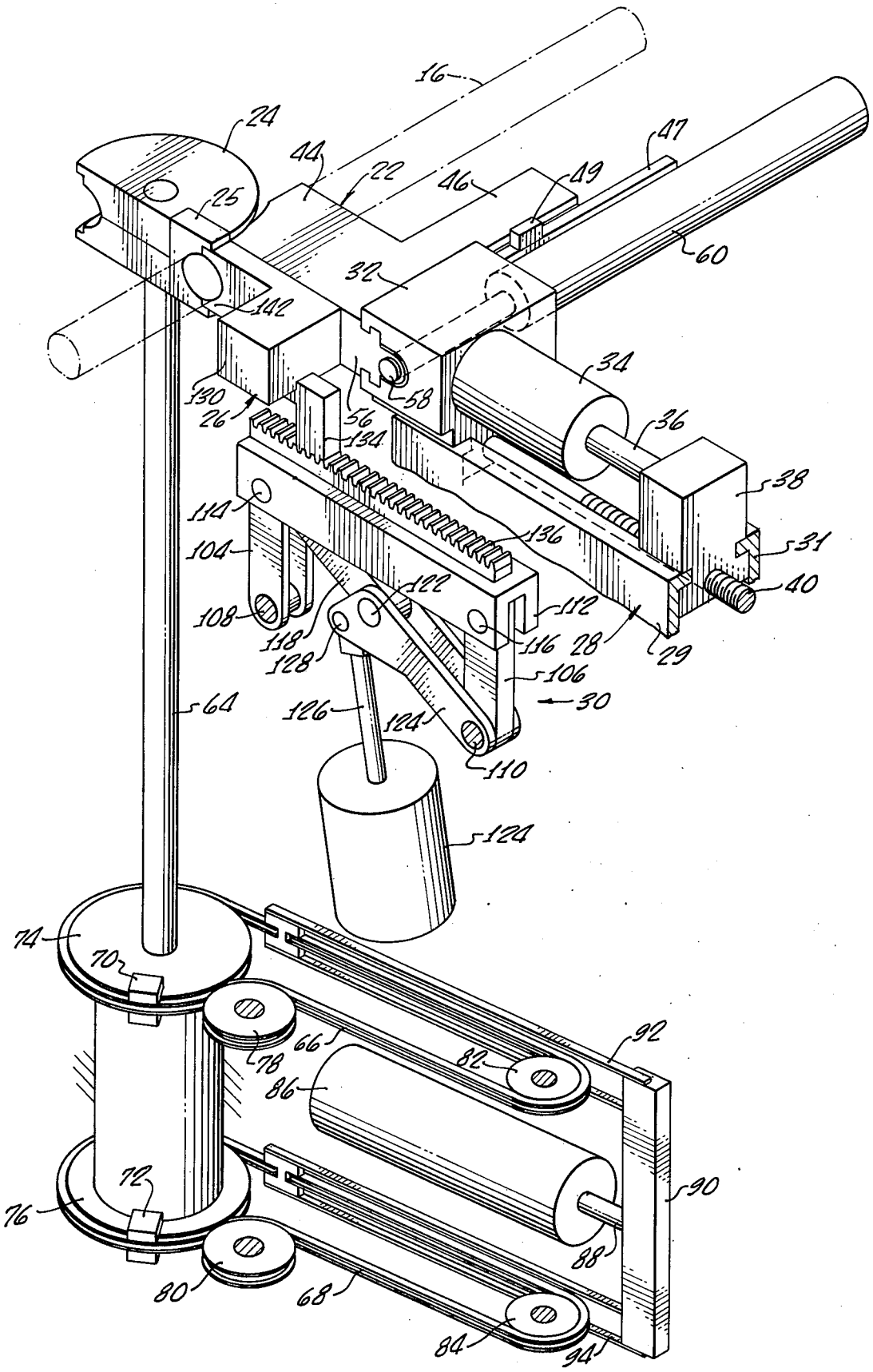
FIG. 2 is a schematic perspective view of certain operating components of the bending apparatus of FIG. 1.
Figure 4:
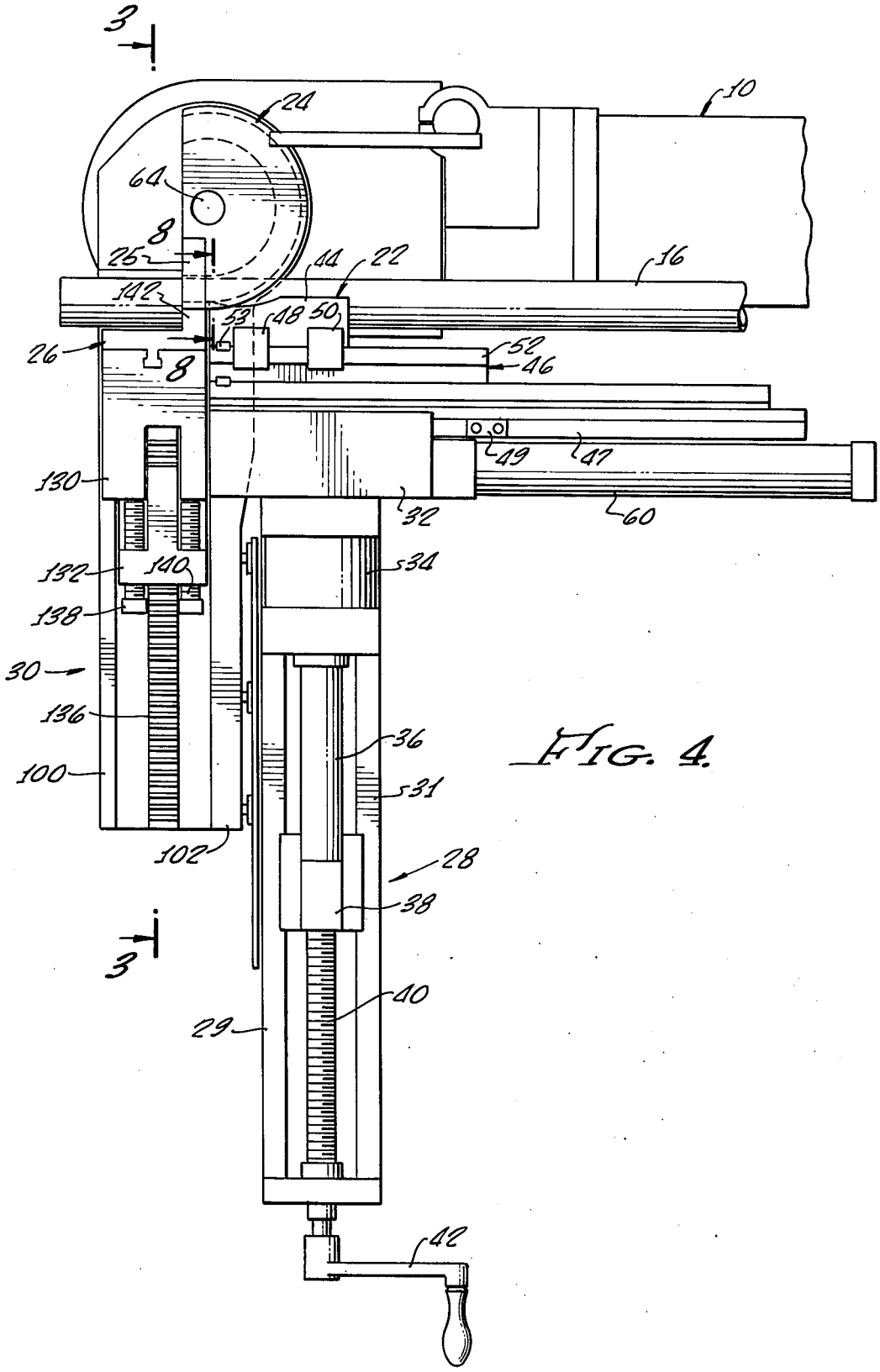

Referring to FIGS. 1, 2 and 4, bend die 24 is fixed to a bend arm shaft 64 that is journalled for rotation about a vertical axis in the fixed structure of the bending head assembly. Shaft 64 is rotated by upper and lower endless drive chains 66, 68 which are respectively fixed by chain lugs 70 and 72 to upper and lower shaft drive wheels 74 and 76, fixedly connected to the shaft 64. The chains 66 and 68 are entrained about respective idler chain flanged rollers 78, 80 and respective idler chain rollers 82, 84 and are driven by means of an hydraulic cylinder 86 having a piston rod 88 fixed to a yoke 90 which has opposite ends thereof fixedly connected to the chains 66 and 68 by means of fixed yoke legs 92, 94, respectively. Accordingly, as cylinder 86 is pressurized to drive piston rod 88 to the right as viewed in FIG. 2, the yoke 90 and yoke legs 92, 94 move toward the right to pull both chains in a clockwise direction around the idler rollers. Entrained about the bend die shaft wheels 74, 76 and fixed thereto by means of the chain lugs 70, 72, the chains rotate bend die shaft 64 in a clockwise direction and thereby rotate bend die 24 and the bend arm assembly 30.

Bend arm assembly 30 (FIGS. 1, 2, 3) comprises an arm body having a pair of spaced side plates 100, 102 fixedly mounted to the bend arm shaft 64 and rotatable therewith. The bend arm body carries front and rear support links 104, 106 pivoted to the body on pivot pins 108, 110, respectively, and pivoted to a bend arm slide 112 at pivot pins 114, 116 to thereby provide a parallelogram linkage support of the bend arm slide. A toggle link 118 and a cylinder toggle link 120 are pivotally connected to each other at pivot 122 and have the other ends thereof pivoted respectively to the pins 114 and 110.

A clamp cylinder 124 is pivotally carried by the bend arm assembly body and has a piston rod 126 thereof pivoted at pin 128 to the toggle link 120 adjacent the pivot pin 122. Accordingly, the bend arm slide may be moved on its parallelogram linkage support, under forces provided by the clamp cylinder 124, from the clamping position illustrated in solid lines in FIG. 3 to the retracted position illustrated in dotted lines in this figure.

Adjustably but fixedly carried on the bend arm slide 112 is a clamp die bolster 130 that is slidably keyed (for motion from right to left as viewed in FIG. 3) to the bend arm slide 112. A clamp die adjusting block 132 has a depending toothed leg 134 of which the teeth mesh with teeth of a rack 136 fixed to the top of the bend arm slide 112. Block 132 is adjustably connected to clamp die bolster 130 by means of a pair of screws 138, 140 (FIG. 4). Coarse adjustment of the bolster and adjusting block is achieved by slightly raising the adjusting block and moving this together with the bolster to a different position of engagement of teeth 134 and rack 136. Thereafter fine adjustment of the clamp die bolster is made by operation of screws 138, 140.

Clamp die assembly 26 includes the clamp die bolster 130, clamp die adjusting block 132 and the clamp die itself, designated at 142. Die 142 is detachably but firmly mounted to and upon the clamp die bolster.

As illustrated in FIGS. 7, 8 and 9, all of the dies are formed with die cavities of a somewhat oval or flattened circular configuration which receive the tube when pressed therein and tend to flatten the tube in a vertical direction, thereby to counteract the tendency of the tube to flatten in a horizontal direction when being bent about a vertical axis.

Pressure die 44 is formed with a pair of inwardly facing edges 150, 152 between which is formed the wiper die cavity 154. Both of the edges 150, 152 form guide surfaces which are adapted to cooperate with peripheral shoulders 156, 158 (FIG. 7) formed on the circular periphery of bend die 24 and between which is formed the bend die cavity 160. Bend die 24 has a circular periphery of somewhat more than 180° since bends of greater angles are not required. If deemed necessary or desirable, the bend die could be made in a complete circular configuration rather in a circular sector illustrated.

According to a feature of the specifically illustrated embodiment of the invention, guide edges 150 and 152 of the wiper or pressure die are inclined with respect to the direction of forward motion of the wiper die. Specifically, such inclination is provided by the arcuate configuration of each such edge for a portion of its length, designated at 162.

BENDING METHOD

The apparatus described herein may be simply and rapidly operated to perform the unique and improved draw bending of the present invention which includes starting a bend by compression bending and continuing the bend by draw bending. Compression bending may be defined as embodying the bending of a tube around a bend die without subjecting the tube to an amount of axial elongation. Draw bending may be defined as embodying the bending of a tube around a bend die and concomitantly stretching it by subjecting the tube to an axial tension above the yield point of the tube material.

In operating the described apparatus to perform the method of this invention, the bend arm assembly is positioned in its start position which is illustrated in FIGS. 1, 2 and 4. The clamp and wiper dies are first retracted and a tube 16 is positioned by means of the carriage and chuck to the position such as illustrated in FIG. 4. Now, clamp cylinder 124 is operated to move the clamp upwardly and to the left (as viewed in FIG. 3) to forcibly clamp the tube 16 into the mating cavities of clamp die 142 and bend die 24. Edges 168, 170 of the clamp die abut shoulders 156, 158 of the bend die. Pressure cylinder 34 is also actuated to drive the pressure die assembly toward the tube 16 until the forward portion of pressure die edges 150 and 152 abut the shoulders 156, 158 of the bend die, as shown in FIGS. 4 and 4a. FIG. 7 shows the bend and pressure dies as the latter approaches the position at which bending may start.

When the parts are in position to begin bending, but before any bending action has commenced, the tube is firmly clamped between the clamp die 142 and bend die 24, being substantially completely, but not entirely, forced into the cavities thereof in an arrangement similar to that illustrated in FIG. 8. The forward portion of the guide edges 150, 152 of the pressure die 44 are in contact with the guide surfaces or shoulders 156, 158 of the bend die, as shown in FIG. 8. However, only a relatively light pressure is exerted upon the tube by pressure die 44 because of the relatively great extent (toward the left as illustrated in FIG. 8) of the forward portion of the pressure die guide edges. Thus, as illustraed in FIG. 8, tube 16 is only partly pressed into the cavities of dies 24 and 44 at the commencement of the bend.

Energization of pressure cylinder 34 and clamp cylinder 124 is maintained at a constant level throughout the bend operation. A steady pressure (throughout the entire bend operation) is also exerted by booster cylinder 60 which tends to move the pressure die forwardly, in a direction parallel to the axis of tube 16. This motion is resisted by the clamp die and bend die operating mechanism until rotation of the bend die is commenced.

Now the bend operation is commenced by energizing bend die cylinder 86 to rotate bend shaft 64 and bend die 24 in a clockwise direction as viewed from the top. The bend arm assembly together with the clamp die assembly mounted thereon rotates, carrying the tube 16 clamped therebetween around the periphery of the bend die 24. As the clamp die rotates through its initial angle (a small angle, as will be described below), pressure of the booster cylinder 60 upon pressure die slide 46 causes the pressure die to move forwardly along its slide mounting in the die bolster 32, in a direction substantially parallel to the tube axis. Thus, substantially no axial restraint or tension is exerted on the tube during this part of the operation. In this initial part of the bend operation, the parts move from the position of FIG. 4 (and 4a) toward the position of FIG. 5 (and 5a). During this motion from the position of FIG. 4a toward the position of FIG. 5a, the force of pressure cylinder 34 continues to press the pressure die assembly toward the bend die, in a direction transverse to the axis of tube 16.

As pressure die 44 moves forwardly (to the left in FIGS. 4, 5), this pressure of cylinder 34 together with the inclined or arcuate configuration of edge portions 162 of the pressure die, causes the interengaging guide surfaces on the pressure and bend dies to allow these dies and, more specifically the cavities of these dies, to more closely approach each other as the bend die rotates through its initial angle. This arrangement, wherein the die cavities approach each other, drives the tube deeper into the cooperating cavities of the bend die and the pressure die at the point of tangency of the tube 16 upon the bend die. The pressure cylinder 34 exerts a force substantially normal to such tangency. The effective cross-sectional area of the cavity collectively defined by bend and pressure die decreases as bending commences. Thus, the constant force of pressure cylinder 34 produces an increasing pressure upon the tube. Stated otherwise, for the initial bend angle, cavity area decreases and pressure die pressure increases as the angle of bend die rotation increases.

As the parts move from the position of FIG. 4a to the position of FIG. 5a, stop 49, carried on the pressure die slide rear extension 47, approaches the rearwardly facing surface of the die bolster 32 and, as shown in FIG. 5, contacts this surface and thereby prevents further forward motion of the pressure die. At this limit of wiper die forward motion, the arcuate configurations of pressure die guide edges 150, 152 mate with and are in extensive contact with the congruent arcuate bend die shoulders 156, 158. Such an arrangement is illustrated in FIG. 9 which shows the tube now pressed firmly and fully into the mating cavities of pressure and bend dies, and slightly deformed therein by such pressure.

In the position of FIG. 5a, the tube has been partly bent around the periphery of the bend die. That portion of the tube to the rear of the clamp die, up to and including the point of tangency of the tube upon the bend die, has been further pressed against and into the bend die cavity. Accordingly, the frictional force between the tube and dies, as it bends around the bend die and is more fully within the bend die cavity, has been significantly increased. This is so even though the pressure exerted upon the tube by the clamp die remains the same. In other words, the action of employing the compression bending (allowing the pressure die to move forwardly from the position of FIG. 4a to the position of FIG. **5*a*) to partly bend the tube around the bend die and concomitantly to drive the tube further into the cavity of the bend die, has significantly increased the holding force of the clamp upon the tube as compared to the holding force exerted by the clamp and bend die upon the tube in the position of FIG. 4*a*. This holding force has increased to such an extent that even with a relatively short clamp die and relatively low pressure of the clamp die against the tube, draw bending may now take place. Thus, having reached the position of FIG. 5*a*, the clamping pressure of a r elatively small clamp die upon the tube is sufficient to provide a holding power (without unacceptably deforming the tube) which will tension the tube as the bend and clamp dies further rotates and which will stress it beyond its yield point for a draw bending operation. Concomitantly, forward motion of the pressure die is no longer possible since it is prevented by the abutment of stop 49 and bolster 32**. In addition, the pressure die has been moved toward the bend die to more tightly grasp the tube therebetween.

Now bending may continue with the parts moving from the position of FIG. 5 and **5*a* to the position of FIG. 6, assuming the latter is a final position for a desired bend. During this continued bending from the position of FIG. 5 to that of FIG. 6, draw bending occurs. Pressure die 44** remains stationary. The bend die together with the clamp die and the tube end grasped therebetween, continue to rotate in a clockwise direction about the bend die axis and the tube is drawn around the periphery of the bend die, being slidably drawn through the mating cavities of bend and pressure dies, which exert sufficient frictional resistance to such axial sliding as to effect axial elongation of the tube in a common draw bending action.

It will be seen from the above description that pressure die 44 is constructed and arranged to perform two functions in this bending operation. First, it operates to hold the tube against the bend die without exerting significant axial restraint, thus acting in a compression bending mode. This die is caused to gradually change its operation during the initial bending so as to operate in a draw bending mode. This change is produced, in the embodiment described above, by a configuration of the bend and pressure dies that allows the cavities of these two dies to approach each other during the initial angle of rotation of the bend die. Thus, the cavities of the wiper and bend dies are initially positioned with respect to one another as illustrated in FIG. 8 and thereupon approach each other (because of the inclination of the guiding surfaces in this embodiment) to attain he relative position illustrated in FIG. 9.

The purpose of this relative motion of the two cavities, as previously mentioned, is to increase the pressure of the bend and pressure dies upon the tube to enable a draw forming operation. In the illustrated embodiment, the approach of the two cavities is achieved by a arcuate inclination of the guiding edges of the pressure die. It will be readily appreciated that many other arrangements may be employed to achieve this increase in pressure upon the tube between the wiper and bend dies. For example, the dies may be arranged so that initially, at the start position of FIG. 4, for example, the pressure and bend dies are not in contact and the force of pressure cylinder 34 is resisted by the tube interposed therebetween. Then, as bending starts and the bend and clamp dies are rotated, force exerted by pressure cylinder 34 is increased as rotation angle increases to slightly deform the tube so that when the forwardly moving pressure die reaches the limit of its travel, as controlled by stop 49, the force exerted by pressure cylinder 34 is sufficient to squeeze the tube between the bend and pressure dies for a draw forming operation. In this modification, the pressure die need not have inclined edges.

In some cases, the forward driving force of cylinder 60 may be eliminated so that the pressure die moves with the tube but is driven only transversely of the tube by cylinder 34.

The illustrated arrangement for causing approach of the two cavities (effectively decreasing cavity area) and increasing pressure on the tube is preferred because of the simplicity of machine construction. Existing machines may be readily retrofitted to perform the described combined compression bending and draw bending merely be replacing the pressure die and adding the stop. The clamp die may also be replaced to provide a smaller die and thus take advantage of the increased holding power afforded by the initial compression bending action.

It will be readily appreciated that instead of providing the pressure die with an arcuate guiding edge 162, this edge may be linear, providing a straight ramp, inclined with respect to a tangent to the bend die at the point of contact between bend and pressure dies. Alternatively, instead of providing the inclination on the edges 150 and 152 of the wiper die, these edges may be straight, parallel to the axis of the die, and the inclination may be provided by forming the shoulders 156, 158 of the bend die with an initial eccentric curvature. Thus, as illustrated in the modification of FIG. 11, the guiding edge **150*a* of pressure die 44*a* is straight and the cooperating guide shoulder 156*a* of the bend die 24*a* has an inclined portion that cooperates with and abuts the straight edge 150*a* of the wiper die. Inclined portion of the shoulder 156*a* curves inwardly from a point 156*b* at a first radial distance from the bend die center to a point 156*c* at a smaller radial distance from the bend die center. The difference between the radii to points 156*b* and 156*c* is the distance by which the pressure and bend dies approach each other during the rotation of the bend die through the initial arc, which is substantially equal to the length of the arc 156*b*, 156*c*. Clamp die 142*a* abuts the bend die 24*a* adjacent point 156*b***, where the bend die shoulder radius is larger. Operation of this embodiment is the same as operation of the arrangement previously described.

As shown in FIG. 9, the mutual approach of the pressure and bend die cavities presents a slightly smaller cavity (of decreased cross-sectional area) because of the inclination of pressure die guiding edges 150 and 152. A slight degree of tube deformation results from the squeezing action of the smaller cavity but this is considered to be satisfactory for most applications. It is possible to press the tube between the pressure and bend dies by employing dies without the above-described inclination of the guiding edges but inclining instead the die cavity itself. Thus, by carefully shaping and inclining one or both of the die cavities, and employing the above-described operations of an initial forward motion of the pressure die while continuing to press it transversely against the bend die, the tube may be clamped with increasing pressure between the bend and pressure dies in a cavity of effectively diminishing cross-section.

For some types of operation, the forward driving force of booster cylinder 60 may be omitted and the pressure die allowed to "float" or move with the tube and bend die solely under force of friction between the tube and pressure die.

The magnitude of initial bend angle that occurs before draw bending begins, that is, before the stop 49 abuts bolster 32, may be emperically determined by making trial bends. Optimumly, compression bending may proceed through as great an angle as is possible without wrinkling or buckling the inner side of the tube. Thus, one may determine the angle of bend in compression bending (without axial restraint on the tube) at which wrinkling begins and then decrease such angle by a slight amount for use as the initial compression bending angle of the described method and apparatus. The amount of initial bend angle that can be achieved by compression without buckling or wrinkling of the tube wall depends on tube diameter, tube wall thickness and bend radius. The magnitude of compression bending angle possible without buckling decreases with a high ratio of tube diamter to tube wall thickness and also decreases with a small ratio of bend radius to tube diameter. In other words, for bending a large thin wall tube, only small angles of compression bending are possible without wrinkling. Similarly, for large tubes, compression bend angle must be small if the radius of bend is small.

It is found that for bending of tubes commonly employed as automobile exhaust pipes, compression bending of about 20° is the maximum that may occur without wrinkling or buckling of the tube. In the described embodiment, the bend arm assembly, including the bend and clamp dies rotates 15° from the position of FIG. 4 to the position of FIG. 5, at which position the compression bending is completed and draw bending commences. Although it is possible to stop the operation of the machine in the position of FIG. 5 when the stop first hits the bolster, it is preferable to provide the bend operation in one continuous motion of rotation of the bend arm assembly. Thus, the pressure die and the rear portion of the tube clamped thereby experience a sharp rise in the restraint on axial motion when the pressure die stops completely and the bend arm assembly continues to rotate from the position of FIG. 5 toward the position of FIG. 6.

Whereas prior methods of draw bending required a clamp die having a length of approximately three times the diameter of the tube being bent, it is found that the clamp die employed in the practice of the present invention, need have a length of as little as one-half tube diameter because of the increased holding power provided by the initial compression bend step. Thus, successive bends may be spaced more closely to one another.

The above-described embodiments of the disclosed method and apparatus afford a number of advantages as set forth herein. However, they suffer from a disadvantage common to many types of bending machines, excessive wear of the pressure die due to the wiping action. For the pressure and bend dies to exert a restraining force sufficient to axially elongate the tube during the draw forming part of the bend operation, a large amount of radial pressure must be exerted, pressing the tube between the pressure and bend dies. With the pressure die motionless, being completely restrained by abutment of the stop 49 and bolster 30 as described above, a wiping or sliding action of the tube relative to the bend and relative to the pressure occurs. The high radial pressure combined with sliding of the tube relative to the bend die creates a large abrasive force on the die face. Thus, where this wiping action occurs, it is desirable to use a wear resistant material for the die face, a material such as aluminum bronze, which may provide a satisfactory resistance to this type of wear. However, this material is exceedingly expensive and difficult to machine. Accordingly, modification of the bending apparatus and method is desired to eliminate the wiping action due to the sliding of the tube past the pressure die.

Such an arrangement is illustrated in FIG. 12 wherein the pressure die does not move radially of the bend die at all, after it has been pressed against the tube, but does move together with the tube continuously throughout the entire bend operation. The above-described combination of initial compression bending followed by draw bending is achieved by providing an axial restraint upon the pressure die which restraint increases up to a predetermined amount sufficient to axially tension the tube for the draw bending. This restraint then remains fixed at such amount throughout the remainder of the bending operation. This increased resistance to motion of the pressure die (and therefore to motion of the tube itself) is conveniently provided by an hydraulic cylinder having a pressure control valve that is operated to progressively increase exhaust pressure of the cylinder. It is convenient, in this arrangement, to initially provide an axial compressive force on the tube and pressure die during the above-described initial amount (about 15°) of rotation of the bend die in order to overcome friction in the moving parts of the bending machine.

Thus, there is initially applied to the tube an axial compressive force which facilitates the initial compression bending mode. With this compressive force applied, compression bending is accomplished to a degree sufficient to provide a holding force at the forward portion of the tube adequate for the ensuing draw bending. Then the compressive force is changed to a tensile force, and this tensile force is increased until it reaches an amount sufficient to achieve the draw bending. Thus, just as in the previously described embodiment, a forward portion of the tube is first secured to the bend die by bending the tube around the die without applying tension to the tube, and thereafter bending of the tube around the bend die is continued while applying tension to the tube to achieve the desired draw bending.

In the embodiment of FIG. 12, which is presently preferred, the bending machine and all of its components are the same as described in connection with the previous embodiments. Therefore, these features need not be shown in this drawing. In this embodiment, pressure die **44*b* (corresponding to die 44 of the embodiment of FIGS. 1-9) has a number of fixed upstanding arms 170, 172, 174 which fixedly carry a longitudinally extending cam plate 176 having a cam surface 178 at a forward end thereof. Hydraulic booster cylinder 60*b* (corresponding to cylinder 60 described above) is supplied from a source of pressurized fluid (not shown) and via a conduit 59 with hydraulic fluid under a constant pressure of a magnitude sufficient to just overcome the friction that resists forward motion of the pressure die and tube during bending. Such a pressure may be in the order of 300 lbs. per square inch, for example. Piston rod 58*b* of cylinder 60*b* is fixed to tongue 56*b* carried by the pressure die. This arrangement tends to drive the pressure die 44*b* forwardly under the constant anti-friction bias pressure provided by the pressurized cylinder As the piston 61 and rod 58*b* of booster cylinder 60*b* move forwardly with forward motion of the pressure die and tube, fluid is exhausted from the forward end of the cylinder via a mechanically adjustable pressure control valve 180. Both the valve and the cylinder are fixedly mounted on bolster 32. The valve is connected to the interior of cylinder 60*b* at one side of its piston via a conduit 181 and has a second conduit 183 connected to a sump (not shown) for receipt of exhausted hydraulic fluid. Valve 180, which may be a pressure control valve such as Model C-175 as made by the Vickers Valve Division of Sperry Rand Corporation, operates to control the magnitude of the exhaust pressure of the cylinder. Fluid is exhausted from cylinder 60*b* in accordance with the position of a mechanically operable plunger actuator 182 that forms part of the valve 180. As plunger actuator 182 is moved axially inwardly toward the valve body (downwardly as viewed in FIG. 13**), a greater pressure of fluid within the cylinder is required to exhaust fluid from the cylinder.

Plunger actuator 182 is operated by the cam surface 178 of cam plate 176 as the latter moves forwardly (in the direction of arrow 184) in the course of the bending operation.

Pressure die **44*b*, in the embodiment of FIGS. 12 through 15, has a partial cavity which is the same as the die cavities previously described, but the edges 150*b* and 152*b* of die 44*b* are straight as shown in FIG. 15**. Thus the die and its cavity have a uniform cross-sectional configuration throughout their length.

The parts are positioned as illustrated in FIGS. 12 and 13 at the start of a draw bending operation. Initially, clamp die 26 is driven toward bend die 24 to hold the tube 16 firmly against the bend die. Just as in previously described embodiments, sufficient pressure to hold the tube for draw bending is not exerted upon the forward portion of the tube. The tube will be held on the bend die at least in part by friction after it has been initially bent around the bend die. Pressure die cylinder 34 is operated just as previously described to drive pressure die **44*b* toward the bend die to press the tube between the pressure and bend dies. A constant pessure is exerted upon the pressure die by the pressure die cylinder 34** throughout the entire bending operation.

Booster cylinder **60*b* is pressurized with an antifriction or bias pressure as previously described. This bias pressure applied to the end of the cylinder 60*b* (at the right side of piston 61 as viewed in FIGS. 12 and 14) remains constant throughout the entire bending operation. At this time, just prior to the start of the bend, plunger actuator 182 is adjacent to but slightly spaced from a forward end of the cam surface 178 of cam plate 176, as shown in FIG. 13. Now the swinging bend arm assembly is operated to begin rotation of the bend die 24 together with clamp die 26 and thus to begin to bend the tube 16 about the bend die. This is the initial compression bending operation which is substantially similar to the initial compression bending operation described above in connection with the other embodiments. During this initial bending, which continues for approximately the first 15° of a bend as previously described, no axial tension is exerted upon the tube and no restraint is exerted upon the pressure die or the tube. To the contrary, in order to overcome friction and to decrease the force required to rotate the bend die, the booster cylinder 60*b* actually applies a forward driving force upon the pressure die 44*b* which thus exerts a forwardly directed axial compressive force upon the tube 16**. This forwardly directed axial compressive force, as previously described, is established at an amount approximately equal to the frictional drag forces of the initial compression bending operation.

After the initial compression bending operation, after the tube has been bent around the bend die for approximately 15°, the pressure die and its cam plate have moved forwardly by an amount that causes the surface of actuator plunger 182 to contact the surface 178 of cam plate 176 at a point such as 188. Further bending operation and further forward motion of the pressure die will now begin to depress the plunger actuator.

When the compression bending has advanced to a total of about 16° or 17° of bend, the pressure valve plunger actuator 182 has been depressed so as to provide an increase in pressure at the exhaust side of booster cylinder **60*b* of a small amount, such as 50 lbs. per square inch, for example. Thus, at this point in the operation, there is a total of forwardly directed compressive force of 50 lbs. less than there was at the start, namely a force of about 250 lbs. per square inch. As forward motion continues, the plunger actuator 182 is depressed still further until it contacts a point 190 on the surface of cam plate 176, at which point the final and maximum amount of compression of the plunger actuator 182 has been achieved. At this point pressure of hydraulic fluid exhausted from bosster cylinder 60*b* may be on the order of 600 to 700 lbs. per square inch. This exhaust pressure resists forward motion of the piston rod 58*b* which now is being pulled forwardly with the pressure die by rotation of the bend die. Therefore, there is a restraint of 300 to 400 lbs. per square inch (the 300 lb. per square inch forwardly directed bias continues to be applied throughout the operation) upon the pressure die. Thus, the booster cylinder 60*b*, by virtue of the operation of the control valve 180**, now exerts an axial tensile force on the tube.

Further bending continues with the plunger actuator 182 riding further rearwardly along the flat and straight surface 192 of the cam plate 176. The plunger actuator 182 remains in this position for the remainder of the bending operation until the bend is complete. The resistive tensile force on the tube remains fixed throughout the remainder of the bending operation. Cam plate 176 has a length sufficient to maintain this fixed amount of compression of plunger actuator 182 throughout the entire bending operation of a bend having the maximum angle of bend that is to be achieved with this cam plate.

Although a linear sloping cam surface 178 is provided in this embodiment as presently preferred, the surface 178 need not be linear but can be varied to control the rate of change of axial force exerted upon the tube. Further, for some applications, an initial forwardly directed axial compressive force need not be exerted upon the tube and thus the booster cylinder 60b may be initially in an unpressurized condition in which it exerts no forward force upon the die and tube. In such an arrangement, the rearwardly directed axial tensile force exerted by the cylinder upon the tube is begun upon the initial contact of plunger actuator 182 with cam surface 178.

If desired, the cam plate may have its flat, straight cam surfaces 192 variously sloped to provide any desired program of varying axial restraint, including a decrease of restraint at the end of a bend. A second sloping surface 179 on the rear end of cam plate 176 may facilitate return of the cam plate from a position immediately past the valve actuator and may have a different configuration to provide a different program of increase of restraint when the detachable cam plate is reversed.

It will be seen that an intial pure compression bending takes place until the tube is bent to a small amount as illustrated in FIGS. 5 and **5*a***. As this time the forward portion of the tube has been secured to the bend die at least in part by bending the tube around the die without applying tension to the tube. The partially bent tube has been forced into the bending die cavity and is frictionally retained therein against sliding motion relative to the bend die. Thereafter, the swinging bend arm assembly continues its operation and the bending of the tube continues, but a restraining force now begins to build up so as to apply axial tension to the tube sufficient to elongate the tube as the bending die rotation continues beyond its 15° position. Where an anti-friction compressive bias force is applied to the tube, this anti-friction force is decreased at a point commencing at or just after completion of the initial compression bending mode and continues to decrease until it changes its direction, building up in the opposite direction to exert an axial tensile force upon the tube so that the tube will be axially elongated and draw bending begun before undesired effects of too great an angle of pure compression bending occur.

The constant pressure of pressure die cylinder 34 upon the pressure die is sufficient to cause the pressure and bend dies to grip the tube therebetween so that the axial restraining force exerted by these dies is close to but definitely less than the frictional break away force. Thus, the pressure of the pressure die cylinder 34 is established to create a pressure between the pressure die and the bend die, with the tube interposed therebetween, that provides a restraining frictional force between the tube and the dies in the presence of the elongating tensile force, the latter being approximately 80 to 90% of the break away force, an axial force that would cause the tube to slip through the pressing surfaces of the dies. Thus, the tube never slips from the grasp of the pressure and bend dies. The pressure die always moves together with the tube and wear caused by sliding of the tube along the pressure die face is avoided.

In all of the described embodiments, the forward portion of the tube is secured to the bend die to a significant extent simply by a compression bending action which partially bends the tube about the bend die, pressing into the die cavity without exertion of large radial forces that would deform the tube. Thereafter axial tension is applied to the tube during continued bending by restraining motion of the pressure die. The restraint on motion of the pressure die may be sufficient to overcome static and sliding friction, as in the embodiment of FIGS. 1 through 9, so that a sliding action of the tube with respect to the pressure die occurs. Alternatively, this restraining force may be only a partial restraint which resists but does not prevent forward motion of the pressure die together with the tube. In the latter situation, sliding motion of the tube relative to the pressure die is avoided.

There have been described methods and apparatus for bending tubes by a combination of compression and draw bending. The method can be carried out on many different types of existing bending machines merely by modification or replacement of the dies themselves.

The foregoing detailed description is to be clearly understood as given by way of illustration and example only, the spirit and scope of this invention being limited solely by the appended claims.

What is claimed is:

1. Tube bending apparatus comprising a rotatably mounted bend die, clamp die means cooperating with said bend die for clamping a portion of a tube therebetween, pressure die means for pressing a second portion of said tube, means for rotating said bend die and clamp die means to bend said tube around said bend die, means for mounting said pressure die means for movement with said tube as said bend die and clamp die means are moved through an initial portion of rotation, and means for restraining motion of said pressure die means during a subsequent portion of the rotation of said bend die and clamp die means.

2. The apparatus of claim 1 including means for increasing pressure of said pressure die means upon said tube after rotation of said bend die and clamp die means has begun.

3. The apparatus of claim 2 wherein said means for increasing pressure exerted by said pressure die means comprises means for moving said pressure die means toward said bend die to exert increasing pressure upon a tube therebetween.

4. The apparatus of claim 1 wherein said bend die and clamp die means are each formed with cooperating cavities for receiving a tube therebetween, said pressure die means having a cavity cooperating with said bend die cavity to squeeze a tube therebetween, and including means for decreasing the effective area of at least one of said bend and pressure due cavities to increase pressure of said pressure die means upon said tube.

5. The apparatus of claim 1 wherein said bend die and clamp die means are each formed with cooperating cavities for receiving a tube therebetween, said pressure die means having a cavity cooperating with said bend die cavity to squeeze a tube therebetween, and including means for moving said pressure die means toward said bend die during said initial rotation to increase pressure of said pressure die means upon said tube.

6. The apparatus of claim 5 wherein said means for moving said pressure die means toward said bend die comprises means for urging said pressure die means toward said bend die and guide means inclined with respect to the direction of movement of said pressure die means for holding said pressure die means cavity at a decreasing distance from said bend die cavity as said pressure die means moves with said tube.

7. The apparatus of claim 6 wherein said guide means comprises a shoulder on said bend die and an edge on said pressure die means engaging said shoulder, said edge being inclined with respect to the direction of movement of said pressure die means with said tube.

8. In tube bending apparatus having a rotatable bend die, a clamp die rotatable therewith for clamping a tube between the bend and clamp dies, and a pressure die mounted for motion with a tube to be bent and adapted to be pressed against the tube, the improvement comprising means for increasing the pressure of said pressure die upon the tube during an initial part of the bending, and means for restraining said motion of said pressure die with the tube to be bent after said initial part of the bending has begun and during a subsequent part of te bending.

9. The apparatus of claim 8 wherein said means for restraining comprises stop means for preventing further motion of said presure die with said tube after said bend and clamp die have rotated through an initial angle.

10. The apparatus of claim 9 wherein said angle is less than the angle at which said tube begins to buckle.

11. The apparatus of claim 10 wherein said means for increasing pressure of said bend and pressure dies comprises mutually abutting guide means on said pressure and bend dies having a point of mutual contact that allows these dies to approach each other as said bend die rotates through an initial angle.

12. The apparatus of claim 9 wherein said angle is not more than about 20°.

13. The apparatus of claim 8 wherein said means for increasing pressure of said bend and pressure dies comprises abutting guide surfaces on said pressure and bend dies constructed and arranged to permit said pressure die to have a component of motion transverse to the tube as the bend die rotates.

14. The apparatus of claim 8 wherein said means for increasing pressure of said bend and pressure dies comprises mutually abutting guide means on said pressure and bend dies having a point of mutual contact that allows these dies to approach each other as said bend die rotates through an initial angle.

15. The apparatus of claim 14 wherein said guide means comprises a guide surface on said bend die and an abutting guide surface on said pressure die, said pressure die guide surface being inclined with respect to a tangent to said bend die at the point of contact of said bend and pressure dies.

16. The apparatus of claim 15 wherein said means for restraining comprises stop means for preventing further motion of said pressure die with said tube after said bend and clamp dies have rotated through an initial angle.

17. Bending apparatus comprising a machine bed, a carriage mounted for motion on the machine bed, a tube holding chuck mounted on the carriage, a bend arm assembly comprising a bend die rotatably mounted at one end of the machine bed, a clamp slide mounted for rotation with the bend die, a clamp die carried on the clamp slide,
means for moving the clamp die and clamp slide toward and away from said bend die,
means for rotating the bend die, clamp slide and clamp die,
a stationary arm assembly comprising
a stationary arm body,
a bolster mounted to said body for slidable motion transverse to the extent of said bed,
means for driving said bolster on its slidable mounting,
a pressure die mounted to said bolster for slidable motion in a direction along said bed,
means for limiting motion of said pressure die relative to said bolster, and
means for causing said pressure and bend dies to approach each other as said pressure die moves through its limited motion.

18. The apparatus of claim 17 wherein said last-mentioned means comprises mutually abutting guide surface means on said pressure and bend dies for enabling said dies to approach each other as the bend die rotates.

19. The apparatus of claim 18 wherein said guide surface means comprise a guide shoulder on said bend die and an abutting guide edge on said pressure die, said pressure die guide edge being inclined with respect to a tangent to said bend die at a point of contact of said bend and pressure dies.

20. Bending apparatus comprising
a machine bed,
a carriage mounted for motion on the machine bed,
a tube holding chuck mounted on the carriage,
a bend arm assembly comprising
a bend die rotatably mounted at one end of the machine bed,
a clamp slide mounted for rotation with the bend die,
a clamp die carried on the clamp slide,
means for moving the clamp die and clamp slide toward and away from said bend die,
means for rotating the bend die, clamp slide and clamp die,
a stationary arm assembly comprising
a stationary arm body,
a bolster mounted to said body for slidable motion transverse to the extent of said bed,
means for driving said bolster on its slidable mounting,
a pressure die mounted to said bolster for slidable motion along said bed,
booster cylinder means mounted on said bolster and connected to said pressure die to alternatively drive or restrain slidable motion of the pressure die along said bed,
a control valve connected to restrict exhausting fluid from said booster cylinder and having an actuator for varying the amount of restriction of said exhausting fluid,
a cam plate carried by said pressure die having a surface engageable with said control valve actuator and shaped to operate the actuator to increase restriction of exhausting fluid from said cylinder as said pressure die moves along said bed.

21. The apparatus of claim 20 including means for supplying a constant pressure fluid to said cylinder.

22. In tube bending apparatus having a rotatable bend die, means rotatable therewith for pressing a tube against the bend die, and a pressure die mounted for motion with a tube to be bent and adapted to be pressed against the tube, the improvement comprising
means for increasing the force holding the tube against the bend die including
means for pressing the tube against the bend die,
means for rotating the bend die to compression bend the tube through an initial angle while allowing said pressure die to move with the tube without restraint, and
means for restraining motion of the pressure die with the tube to be bent after said initial angle of bending has begun and during a subsequent angle of rotation of said bend die to draw bend the tube.

23. The apparatus of claim 22, wherein said means for restraining comprises means for initiating an increasing restraint upon motion of the pressure die with the tube after the bend die has rotated through said initial angle.

24. The apparatus of claim 23 wherein said angle is less than the angle at which the tube begins to buckle.

25. The apparatus of claim 23 wherein said angle is not more than about 20°.

26. The apparatus of claim 22 wherein said means for allowing said pressure die to move and for restraining motion of the pressure die comprises an hydraulic cylinder connected to said pressure die and means for operating said cylinder to initiate an increasing restraint upon forward motion of the pressure die after bending has begun.

27. The apparatus of claim 26 including means for operating said cylinder to drive said pressure die forwardly with said tube as the tube and bend die are rotated through and initial angle.

28. Tube bending apparatus comprising
a rotatably mounted bend die,
means cooperating with said bend die for pressing a first portion of a tube against the bend die,
pressure die means for pressing a second portion of said tube,
means for rotating said bend die to bend said tube around said bend die,
means for mounting said pressure die means for movement with said tube as said bend die is moved through an initial rotation, and
means for initiating an increasing restraint upon motion of said pressure die means during a subsequent portion of the rotation of said bend die, after said bend die has been rotated to bend said tube partly around said bend die.

29. The apparatus of claim 28, including means for driving said pressure die means forwardly with said tube during an initial rotation of said bend die.

30. The apparatus of claim 29, wherein said means for restraining motion of said pressure die means comprises a fluid cylinder connected to said pressure die means, and means responsive to forward motion of said pressure die means as bending of the tube around said bend die continues for providing an increased

31. The apparatus of claim 30, wherein said means for providing an increased restriction comprises a variable control valve connected to exhaust fluid from said cylinder and cam means connected with said pressure die means for actuating said control valve.

* * * * *

UNITED STATES PATENT AND TRADEMARK OFFICE

CERTIFICATE OF CORRECTION

PATENT NO. : 4,063,441

DATED : Dec. 20, 1977

INVENTOR(S) : Homer L. Eaton

It is certified that error appears in the above-identified patent and that said Letters Patent are hereby corrected as shown below:

Col. 1, line 17: change "fo" to ---for---;

Col. 3, line 55: provide a hyphen between "above" and "identified";

Col. 8, line 37: change "rotates" to ---rotate---;

Col. 10, line 41: change "diamter" to ---diameter---;

Col. 16, line 25: change "presure" to ---pressure---;

Col. 18, line 61: after "increased" add ---restriction to exhaust of fluid from said cylinder.---.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*